US006814354B1

(12) United States Patent
Li

(10) Patent No.: US 6,814,354 B1
(45) Date of Patent: Nov. 9, 2004

(54) LABYRINTH TYPE MENTAL GAME MACHINE

(76) Inventor: Chunjie Li, Room 602, Building 36, 2nd Neijiang District, Shanghai, 200093 (CN)

( * ) Notice: Subject to any disclaimer, the term of this patent is extended or adjusted under 35 U.S.C. 154(b) by 9 days.

(21) Appl. No.: 10/343,320

(22) PCT Filed: Jul. 28, 2000

(86) PCT No.: PCT/CN00/00215

§ 371 (c)(1),
(2), (4) Date: Jan. 28, 2003

(87) PCT Pub. No.: WO02/20106

PCT Pub. Date: Mar. 14, 2002

(51) Int. Cl.[7] ..... A63F 9/06
(52) U.S. Cl. ..... 273/153 R; 273/153 S
(58) Field of Search ..... 273/153 S, 153 R, 273/281

(56) References Cited

U.S. PATENT DOCUMENTS 4,470,601 A * 9/1984 Finn ..... 273/153 S
5,205,557 A * 4/1993 Kuo ..... 273/153 S
5,427,379 A * 6/1995 Lee ..... 273/281
5,687,970 A * 11/1997 Clark ..... 273/153 S

* cited by examiner

*Primary Examiner*—Steven Wong
(74) *Attorney, Agent, or Firm*—Baker Botts LLP

(57) ABSTRACT

This invention is a maze game, comprising a shell, an operating apparatus, several indicating apparatuses that comprise indicating panel, shadeguide, turning guide, swing turnable cover and pendulum rod; at the top of the rack is the central hole on which indicating panel is placed and the bottom of the rack is external cylinder through which swing turnable cover passes; operating apparatuses comprise movable block and fluted disc. It is possible to observe the color or pattern change of the indicating apparatus directly and to directly operate the color or pattern of the indicating panel to the set status by just using the operating apparatus to facilitate the player's observation and visual operation, to ensure a compact structure and to strengthen the interest of competition.

8 Claims, 5 Drawing Sheets

LABYRINTH TYPE MENTAL GAME MACHINE

BACKGROUND OF THE INVENTION

1. Technical Field

This invention relates to a toy, to be more exact a maze intellectual game advantageous to tap intellectual resources, enhance the analysis and judgement capacity, nurture one's capabilities and reinforce one's memory.

2. Background Art

Present intellectual games include magic cube, transformer, puzzle ring, building block and various picture arrangement toys etc. They have their own distinctive features. Transformer, building block and picture arrangement is of simple structure and comparatively easy. Thus they are only applicable to younger kids; puzzle ring is composed of several components that need to be decomposed one by one. Even if it is rather difficult to assemble and decompose each component, one may lose interest in it and feel monotonous once he/she has known the knack. Magic cube with bright colors is a challenge to a player. However, the player may become bored if he/she fails to find the secret to it. What's more, puzzle ring and magic cube are too difficult for younger kids. "Arithmetic Intelligence Game," Chinese Patent No. No. ZL 97235209.0, is designed against the shortcomings of the above toys. Compared with the above toys "Arithmetic Intelligence Game" is rich in variation and beneficial to cultivating one's logical thinking, judgement capacity and patience and will never make the player feel bored. However, index bar up-and-down is used to show the status change, which is not obviously visible to the naked eyes. The player has to observe index up-and-down one by one and may feel tired. In a word, it is not so interesting.

CONTENTS OF THE INVENTION

It is, therefore, a primary object of the present invention to provide a more interesting maze intelligence game which is rich in variations, has adjustable difficulties and is applicable to the players of all age.

In order to achieve the above object the invention adopts the following technologies: the game comprising a shell, an operating apparatus, several indicating apparatuses, a bedplate at the bottom of the shell, several vertically upward racks fixed on the bedplate and arranged orderly in length and breadth whose number corresponds to that of indicating apparatuses, slideway grooves between the racks and between the racks and all sides of the shell. Each indicating apparatus is set on a corresponding rack. The operating apparatus is engaged in the vertical and horizontal slideway grooves. When the operating apparatus slides along the slideway grooves, the status of indicating apparatus on the passed rack is changed. When the indicating apparatuses on all racks reach the set status, the game is over. Wherein:

the several indicating apparatuses are of the identical structure, having an indicating panel, a shadeguide, a turning guide, a swing turnable cover and a pendulum rod;

the several racks are of the identical structure. The top of each has a central circular hole to place an indicating panel on it, while the bottom is the external cylinder, through which the swing turnable cover of indicating apparatus may pass. In the external cylinder whose outboard boasts a straight slot and an inserting slot there is one central through-hole, through which the pendulum rod extends.

According to a preferred design the operating apparatus is a movable block on the top and a fluted disc at the bottom that forms a link gear with the turning guide of the indicating apparatus and/or the swing turnable cover. The movable block and the fluted disc are integrated whole.

The said several racks and several corresponding indicating apparatuses may have multi groups of arrangement, namely 3-row and 3-line, 3-row and 4-line, 4-row and 4-line and 5-row and 4-line.

In the indicating apparatus:

Each indicating panel has a sign to indicate the direction. In the middle of the indicating panel there is an observing window;

Turning guide is of closed or unclosed cylinders. External periphery at its bottom has a circle of teeth. The cylinder center is a cavity, in which a shadeguide may swing;

Each shadeguide has different color zones or patterns that are in the cavity of the turning guides;

There are gullets at the upper periphery of the swing turnable cover, while there are cam slots for the pendulum rod at interior side of the bottom. A central hole for slide fitting with the external cylinder of the rack bottom is in the middle of the swing turnable cover;

A pair of straight pins are symmetrically set at both sides of the pendulum rod. At one side of the pendulum rod there is side foot that passes through the straight slot of the rack.

The fluted disc of the said operating apparatus may be of double-layered type, both of which have contacting gears. The contacting gears at the upper fluted disc mesh the teeth on the turning guides, while those at the bottom one mesh the gullets on the swing turnable cover.

The operating apparatus may designed to be single-layered type that has contacting gears either meshing the teeth on the turning guides or meshing the teeth on the gullets on the swing turnable cover.

DESCRIPTIONS OF THE FIGURES

MODE OF CARRYING OUT THE INVENTION

Figure 1:
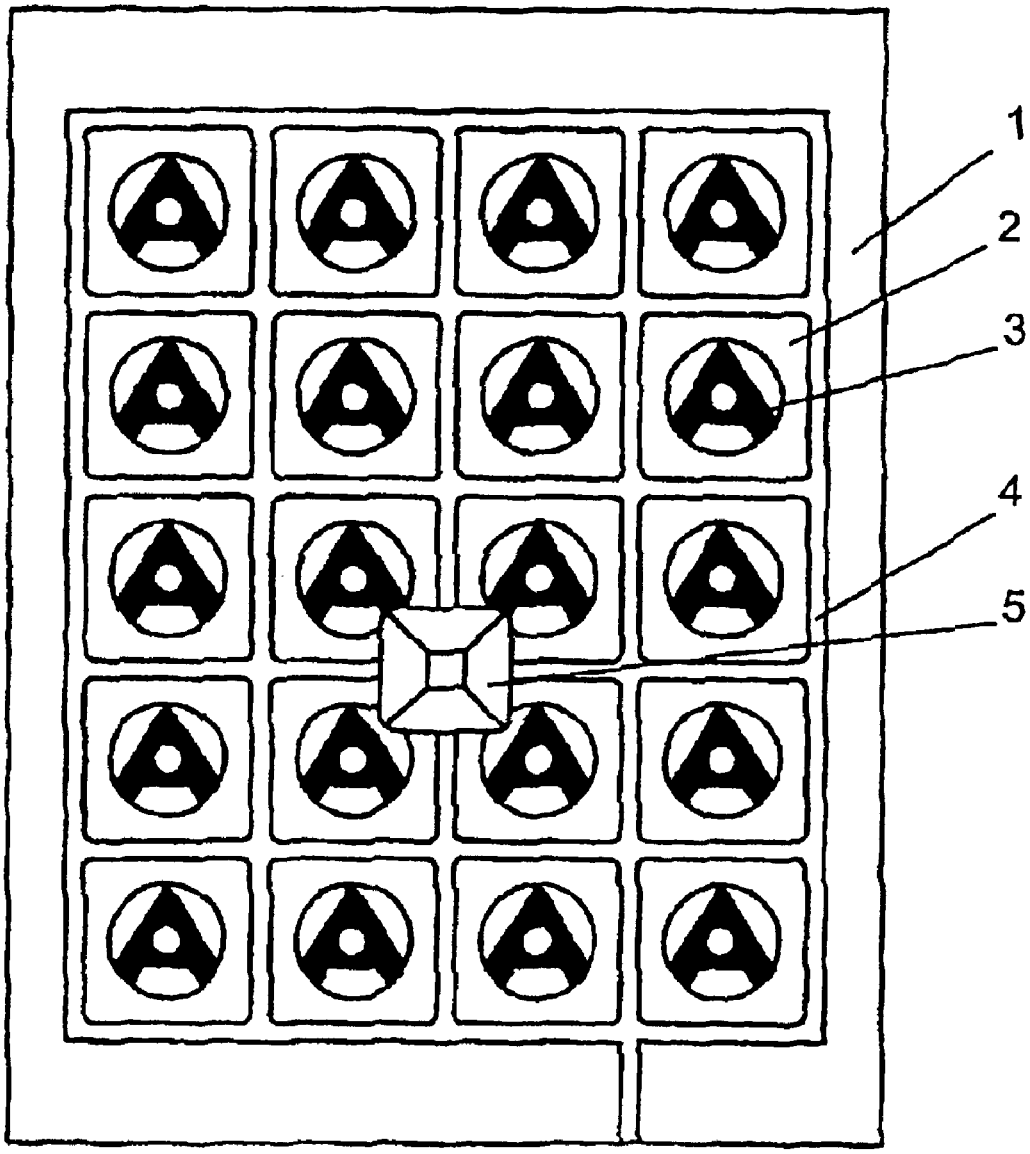
FIG. 1 is top view of the invention.
Figure 2:
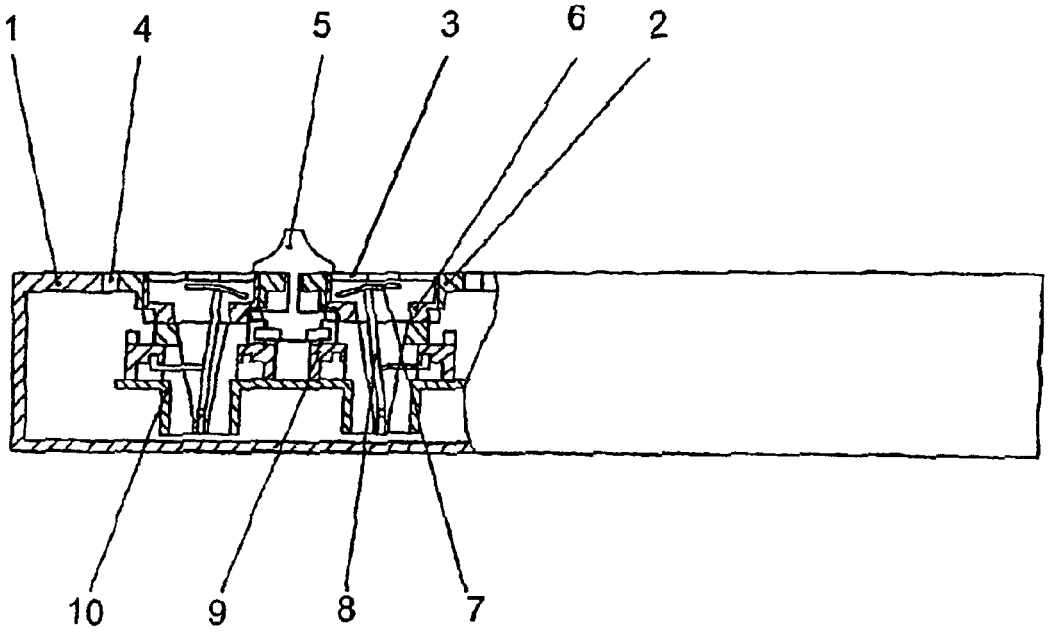
FIG. 2 is partial section view of the present invention.

Please refer to FIG. 1 and FIG. 2. As the embodiment of the invention this intelligence game comprises a shell 1, an operating apparatus 5, several indicating apparatuses, a bedplate 10 fixed at the bottom of shell 1, several vertically upward racks 2 fixed on the bedplate 10 and arranged orderly in length and breadth whose structures are identical, slideway grooves 4 located either between the racks 2 or between the racks 2 and the shell 1, indicating apparatus set corresponding to each rack 2 whose number is equal to that of indicating apparatus. Operating apparatus 5 is engaged in the slideway grooves. When operating apparatus 5 slides along slideway grooves 4, the status of the indicating apparatus on the passed rack 2 is changed. When the indicating apparatuses on all racks 2 reach the set status, the game is over.

Figure 3:
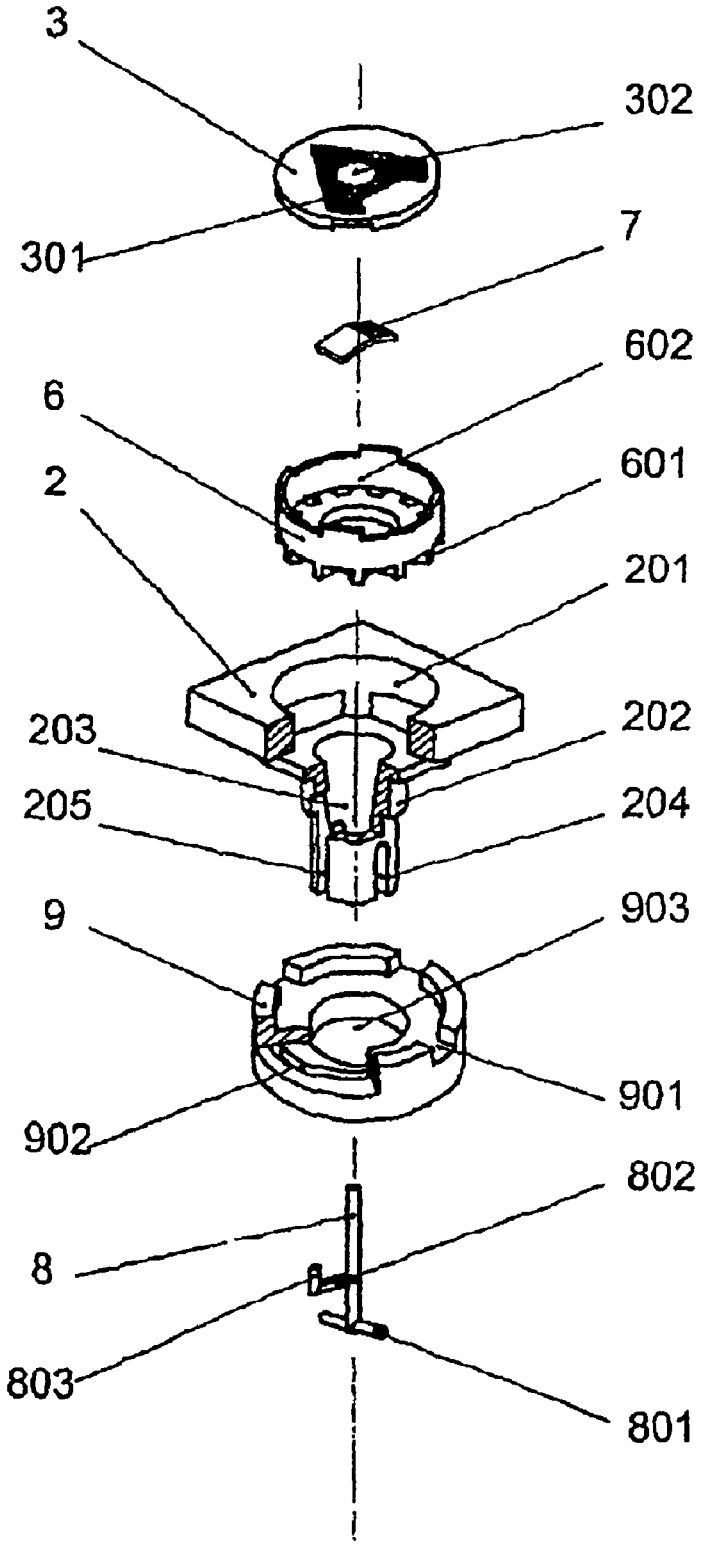
FIG. 3 is sketch map of structural decomposing (including partial section view) of the indicating apparatus and the rack.

Now referring to FIG. 3:

Each indicating apparatus is generally of identical structure and includes an indicating panel 3, turning guide 6, shadeguide 7, pendulum rod 8 and swing turnable cover 9. Turning guide 6 supports indicating panel 3 at the top and places it in the central hole 201 of rack 2. Indicating panel 3 moves with turning guide 6. Turning guide 6 is of closed or unclosed cylinders. External periphery at its bottom has a circle of teeth 601. The cylinder central is a cavity 602, in which shadeguide 7 may swing.

There are gullets 901 at the upper periphery of swing turnable cover 9, while there are cam slots 902 for pendulum rod 8 at interior side of the bottom. A central hole 903 for slide fitting with the external cylinder 202 at the bottom of rack 2 is in the middle of swing turnable cover 9. Swing turning plate 9 slide fits in with external cylinder 202 at the bottom of rack 2. Pendulum rod 8 passes through central hole 201 of rack 2. One end of pendulum rod 8 fixes on shadeguide 7. A pair of straight pins 801 are symmetrically set at both sides of pendulum rod 8 and embedded in inserting slots 204 at both sides of rack 2 so that pendulum rod 8 is enabled to swing with this pair of straight pins 801 as pivot points. At the top of pendulum rod 8 there is side foot 802, passing through straight slot 205 of rack 2. The end of side foot 802 is a hook 803, slide fitting in with cam slot 902 at the bottom of swing turnable cover 9. When swing turnable cover 9 rotates, cam slot 902 drives pendulum rod 8 to swing back and forth along straight slot 205 on rack 2. By such means shadeguide 7 is driven to swing along radial direction in cavity 602 of turning guide 6.

Shadeguide 7 has divided into several zones with different colors or patterns by means of printing, pasting or plastic injection. There is direction sign and observing window 302, through which only part of shadeguide 7 may be observed on indicating panel 3. Therefore, different colors or patterns may be seen from observing window 302 on indicating panel 3 when shadeguide 7 swings in cavity 602 of turning guide 6. The status change of indicating apparatus is shown through direction indication of indicating panel 3 and color or pattern change of shadeguide 7 observed through observing window 302, that is swing of shadeguide. In order to enable the status change of indicating apparatus when operating apparatus 5 slides along slideway grooves 4, external periphery at the bottom of turning guide 6 has a circle of teeth 601 that mesh operating apparatus 5 to change the indication of turning guide 6. Since there are gullets on the periphery of swing turnable cover 9, turning of gullets under the power of indicating apparatus 5 drives the swing of pendulum rod. By such means color or pattern in the observing pattern 302 may change.

Figure 4:
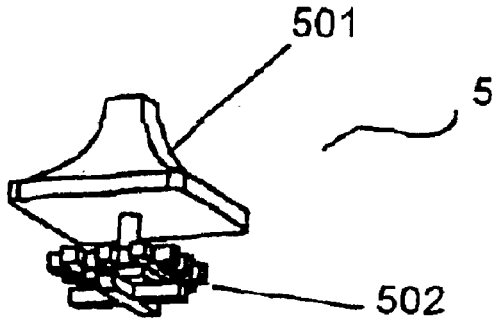
FIG. 4 is the first perspective view of the operating apparatus of the invention.
Figure 5:
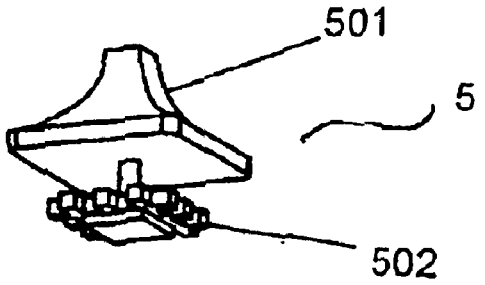
FIG. 5 is the second perspective view of the operating apparatus of the invention.
Figure 6:
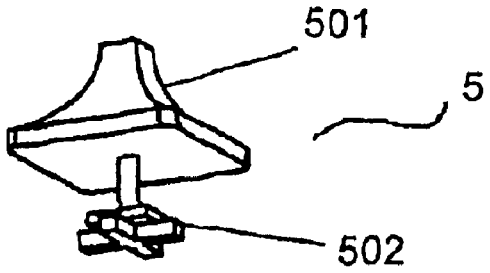
FIG. 6 is the third perspective view of the operating apparatus of the invention.

Referring to FIG. 4 through FIG. 6, the upper of operating apparatus 3 is designed to be movable block 501, while the bottom fluted disc 502 coupling turning guide 6 of indicating apparatus and/or swing turnable cover 9. Movable block 501 and fluted disc 502 are integrated whole. Operating apparatus 5 may be engaged in slideway grooves 4 between racks 2. When operating apparatus 5 slides along slideway grooves, the bottom fluted disc 502 mesh turning guide 6 of the indicating apparatus at both sides and/or swing turnable cover 9 and drive them to turn and drive turning guide 6 to turn and/or shadeguide 7 to swing. When operating apparatus moves all directions of indicating panel 3 and/or colors or patterns in observing window 302 to the set status, the game is over.

The fluted disc 502 at the bottom of operating apparatus 5 maybe of different structure. One is double-layered fluted disc (FIG. 4). There are contacting gears on each layer of fluted disc. The contacting gears at the upper fluted disc mesh the teeth on turning guide 6, while those at the bottom one mesh gullets 901 on swing turnable cover 9. This kind of operating apparatus 5 changes both direction and color or pattern of indicating panel 3. The game is the most difficult. The other is single-layered fluted disc that has also two types (see FIG. 5 and FIG. 6). According to FIG. 5, contacting gears on single-layered fluted disc mesh the teeth on turning guide 6 to change the direction of indicating panel 3. According to FIG. 6 contacting gears on single-layered fluted disc mesh gullets 901 on swing turnable cover 9 to make shadeguide swing. If the operating apparatus with this kind of single-layered fluted disc is used, the game is easier.

Figure 7:
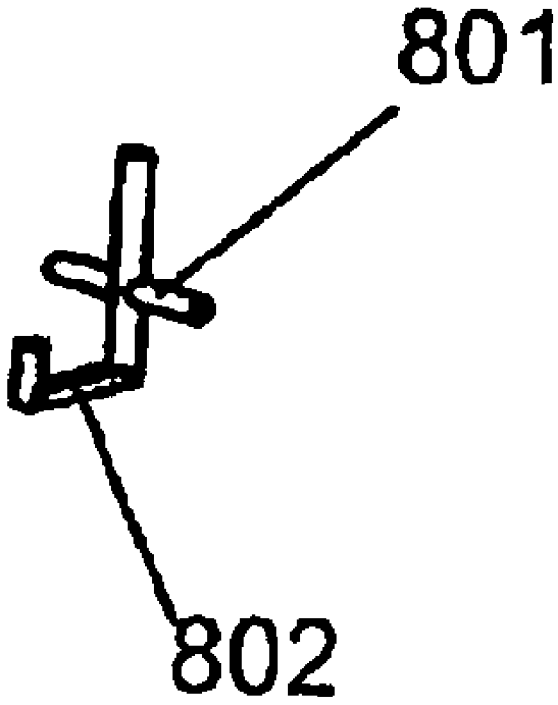
FIG. 7 is a structural perspective view of the pendulum rod of the operating apparatus.

FIG. 7 shows another structure of pendulum rod 8. The positions of straight pins 801 and side foot 802 of this pendulum rod are changed.

Several racks 2 and corresponding indicating apparatuses may have multi groups of arrangement, namely 3-row and 3-line, 3-row and 4-line, 4-row and 4-line and 5-row and 4-line. These arrangements differ in difficulty.

INDUSTRIAL APPLICATION

Compared with current arithmetic intelligence games it is unnecessary to indicate the status change with up-and-down of index bar. Instead it is possible to observe the color or pattern change of the indicating apparatus directly and to directly operate the color or pattern of the indicating panel to the set status by just using the operating apparatus to facilitate the player's observation and visual operation, to ensure a compact structure and to strengthen the interest of competition. Either different arrangement modes of racks or movable blocks with different structures are adopted. As a result the game varies in difficulty. Besides, it is advantageous to nurture one's logical thinking, comprehensive judgement capacity and patience.

What is claimed is:

1. A maze game, comprising:

a shell;

an operating apparatus;

several indicating apparatuses, said several indicating apparatuses each including an indicating panel, a shadeguide, a turning guide, a swing turnable cover and a pendulum rod;

a bedplate at the bottom of the shell;

several vertically upward racks fixed on the bedplate and arranged orderly in length and breadth whose number corresponds to that of indicating apparatuses, each of said indicating apparatuses being set on the corresponding rack; and slideway grooves between the racks and between the racks and all sides of the shell, wherein said operating apparatus is engaged in the vertical and horizontal slideway grooves and slide along the slideway grooves to change the status of indicating apparatus on the passed rack.

2. The maze game of claim 1, wherein said several racks are of the identical structure, the top of each having a central circular hole to place indicating panel on it, while the bottom is an external cylinder, through which the swing turnable cover of indicating apparatus may pass, and wherein in the external cylinder whose outboard boasts a straight slot and an inserting slot there is one central through-hole, through which the pendulum rod extends.

3. The maze game of claim 1, wherein said operating apparatus is a movable block on the top and a fluted disc at the bottom that forms a link gear with the turning guide of the indicating apparatus and/or the swing turnable cover.

4. The maze intelligence game according to claim 1, wherein said several racks and several corresponding indicating apparatuses may have multi groups of arrangement, selected from the group consisting of 3-row and 3-line, 3-row and 4-line, 4-row and 4-line and 5-row and 4-line.

5. The maze intelligence game according to claim 1 wherein in each indicating apparatus:

each indicating panel has a sign to indicate the direction; in the middle of the indicating panel there is an observing window;

the turning guide is a cylinder whose external periphery at its bottom has a circle of teeth and whose central part is a cavity, in which shadeguide may swing;

each shadeguide has different color zones or patterns that are in the cavity of turning guides;

gullets are provided at the upper periphery of the swing turnable cover, while there are cam slots for the pendulum rod at interior side of the bottom; a central hole for slide fitting with the external cylinder of the rack bottom is in the middle of the swing turnable cover; and a pair of straight pins are symmetrically set at both sides of the pendulum rod, at one side of which there is side foot passing through the straight slot of the rack.

6. The maze intelligence game according to claim 5 wherein the fluted disc of the said operating apparatus may be of double-layered type, both of which have contacting gears, the contacting gears at the upper fluted disc mesh the teeth on the turning guides, while those at the bottom one mesh the gullets on the swing turnable cover.

7. The arithmetic intelligence game according to claim 3 wherein the fluted disc of the said operating apparatus may be of a double-layered type, both of which have contacting gears; the contacting gears at the upper fluted disc mesh the teeth on the turning guides, while those at the bottom one mesh the gullets on the swing turnable cover.

8. The maze intelligence game according to claim 4 wherein said operating apparatus is a single-layered type that has contacting gears either meshing the teeth on the turning guides or meshing the teeth on the gullets on the swing turnable cover.

* * * * *